United States Patent [19]

Harre

[11] 4,299,502

[45] Nov. 10, 1981

[54] ASSEMBLY FOR A DETACHABLE CONNECTION FOR A PRINTING ELEMENT IN AN ELECTRIC OFFICE MACHINE

[75] Inventor: Kurt J. S. Harre, Karlshamn, Sweden

[73] Assignee: Facit Aktiebolag, Stockholm, Sweden

[21] Appl. No.: 109,751

[22] Filed: Jan. 7, 1980

[30] Foreign Application Priority Data

Jan. 12, 1979 [SE] Sweden ..... 7900300

[51] Int. Cl.[3] ..... B41J 1/24

[52] U.S. Cl. ..... 400/144.2; 400/175

[58] Field of Search ..... 400/144.2, 144.3, 174, 400/175; 101/93.19

[56] References Cited

U.S. PATENT DOCUMENTS 4,197,022 4/1980 Dollenmayer ..... 400/144.2

FOREIGN PATENT DOCUMENTS 132477 10/1978 Fed. Rep. of Germany ... 400/144.2

*Primary Examiner*—Paul T. Sewell

*Attorney, Agent, or Firm*—Alfred E. Miller

[57] ABSTRACT

The invention relates to a printing unit in an electric office printing machine, and more exactly the invention has for its object to provide an arrangement which makes it possible with a minimum of manual operations to change print elements of circular disc type. This is achieved by moving the printing unit away from the carriage at the same time as the print element by the action of a special coupling is detached from the motor shaft on which the print element is supported, this being possible only when the attachment device for the print element is in such a position that it can receive a new print element.

6 Claims, 5 Drawing Figures

ASSEMBLY FOR A DETACHABLE CONNECTION FOR A PRINTING ELEMENT IN AN ELECTRIC OFFICE MACHINE

BACKGROUND OF THE INVENTION

It is known to use a disengagement device of a special type to facilitate the exchange of a print element in a printing unit of an electric office machine, with the print element being similar to that disclosed hereinafter. This device comprises an operating means for separating the print element from the motor shaft on which it is mounted, so that it can be easily removed.

It is an object of the present invention to further simplify the exchange of the print element and to make it possible, with a minimum of manual operation, and with a limited, relatively small pivoting movement of the support unit, to replace the element.

The present invention relates to an arrangement in a printing unit in an electric office machine for the detachable connection of a print element to a motor shaft.

An embodiment of the present invention will now be described by way of example with reference to the accompanying drawings in which.

Figure 4:
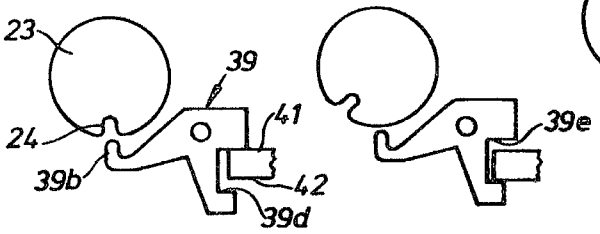
Figure 5:
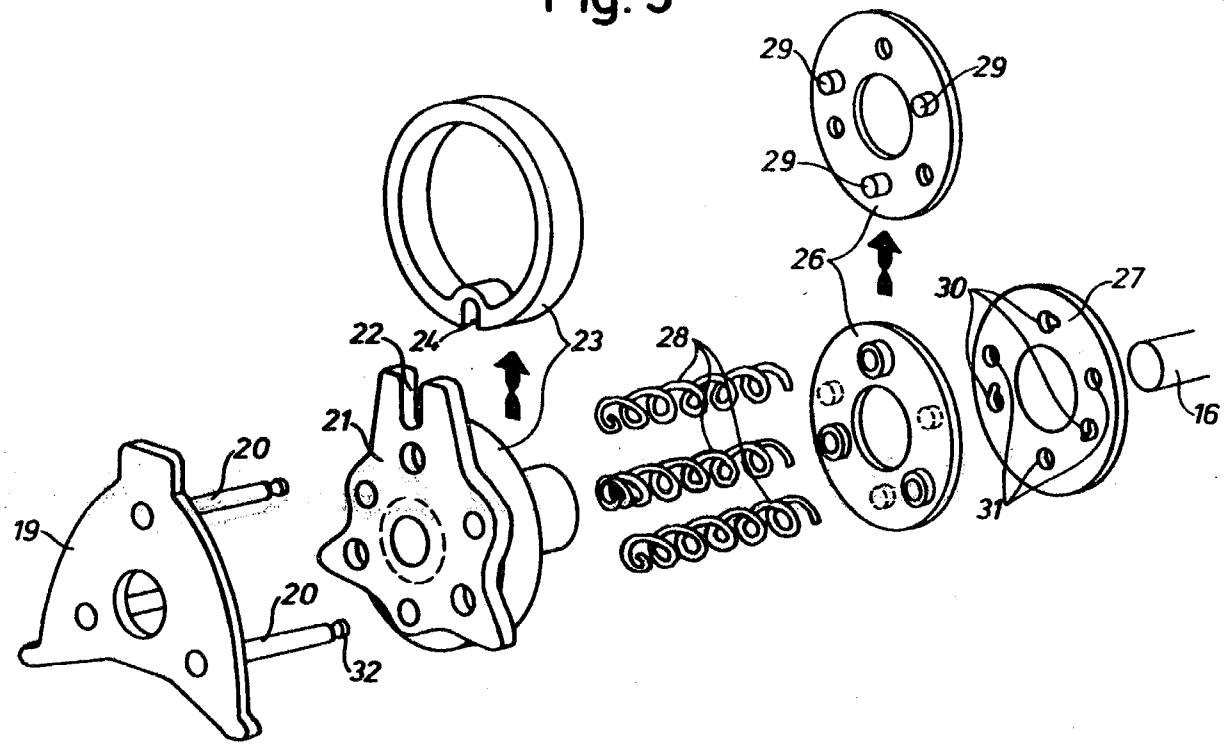

FIG. 4 diagrammatically shows the mode of operation of the device for fixing the position and FIG. 5 is a perspective exploded view of a disengagement device for the print element.

DESCRIPTION OF THE PREFERRED EMBODIMENT

Figure 1:
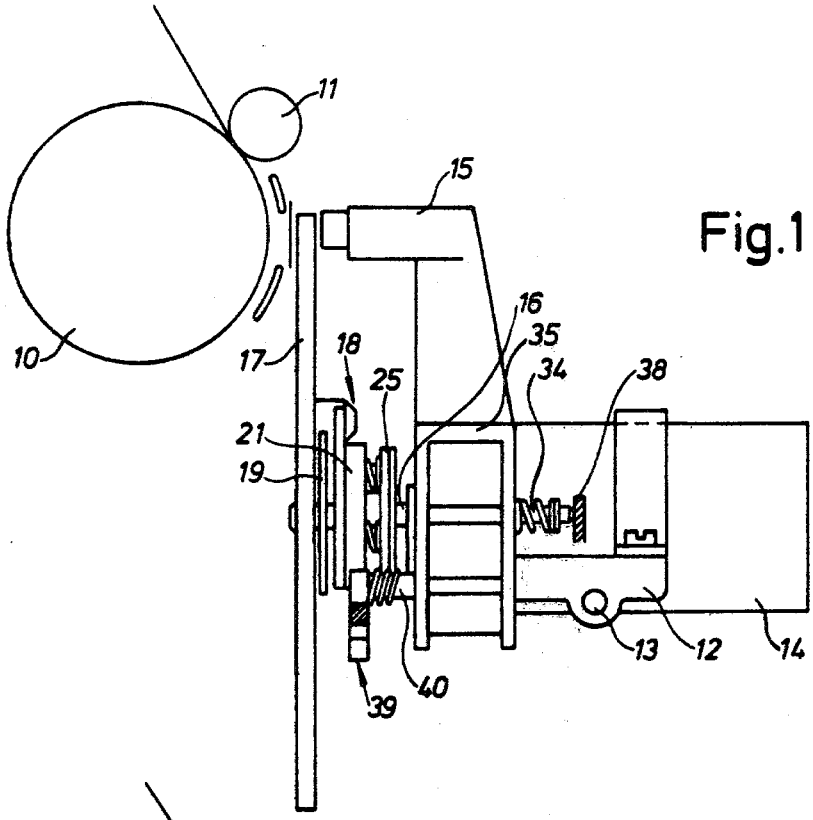
FIG. 1 is a side elevational view of a printing unit in printing position.
Figure 2:
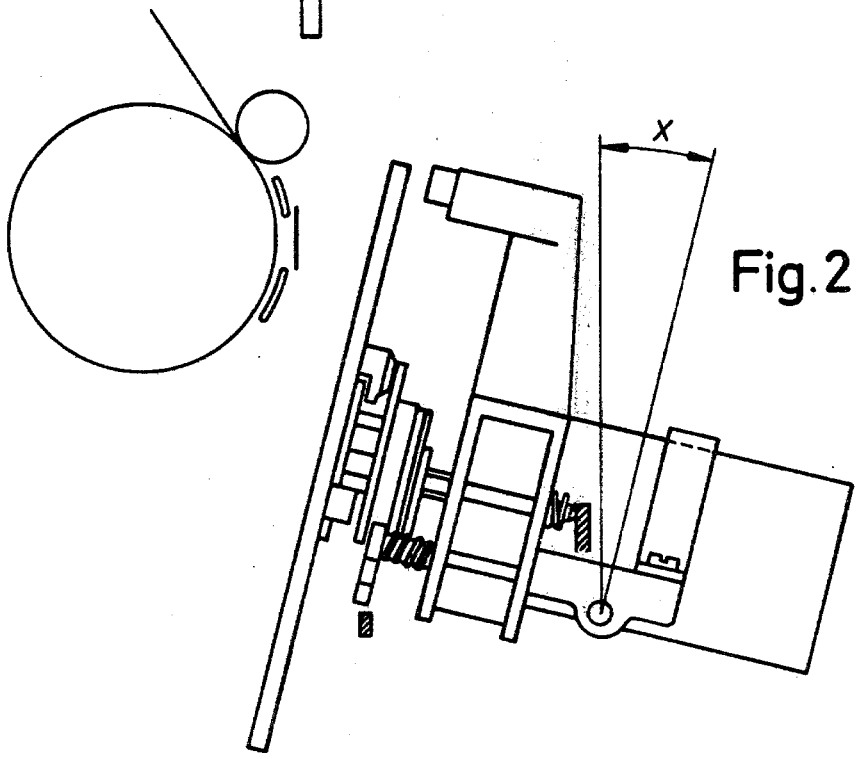
FIG. 2 is a side elevational view of the printing unit in pivoted position.

As seen in FIG. 1, the printing machine is provided with a paper feed platen 10. The paper is pressed against the platen by means of a press roller 11. The printing unit is carried by a support unit 12, which is pivotable about a shaft 13 mounted in a carriage assembly (not shown) which is movable parallel to the platen. The support unit 12 is pivotable about the shaft 13 to the position shown in FIG. 2. The support unit carries a print element motor 14 and a print hammer 15. The motor has a shaft 16 at the end of which a print element 17 is removably mounted by means of a coupling 18. The main function and construction of the coupling and print element is described more in detail in Swedish patent application Ser. No. 7900299-4, filed Jan. 12, 1979, but the coupling of this embodiment wil be disclosed in detail hereinafter in connection with FIG. 5. The coupling comprises a generally triangular fixing plate 19 to which the print element can be secured by hooks which engage with stops on the fixing plate. The plate has rods 20 which extend through a dog member 21. The dog member is attached to the motor shaft 16 and has a guiding recess 22 in which a guide on the print element can engage. The holder also has a lock washer 23 which comprises a cylindrical part with end walls, and on its mantle surface, has a radially directed recess 24. The rods 20 are connected to a pressure plate 25 comprising a guide washer 26 and a lock washer 27 and are surrounded by pressure springs 28. The guide washer 26 has one through hole 26A for each rod, and further is provided with several locking pins 29. The lock washer 27 has several keyhole-shaped openings 30, and additional openings 31 designed to receive the locking pins 29. On assembly of the parts, the rods 20 are moved through corresponding holes 21A in the dog member 21, and the lock washer 23, after which both the pressure springs 28 and the guide washer 26 are inserted on the rods. Then, the lock washer 27 is fixed to the assembly by inserting the rods in the openings 30 of the lock washer 27, which is turned so that grooves 32 at the ends of the rods engage with the narrow portions of the keyhole-shaped openings 30. The lock washer 27 is retained in this position by the locking pins 29 which engage with the openings 31. Thus, the fixing plate 19, by means of the pressure springs 28, is urged against the dog member 21, and is normally positioned slightly inwardly on the motor shaft 16. The arrangement is disengaged by the pressure disc 25 being acted upon in the direction towards the dog member 21, and the fixing plate 19 is moved to a position on an equal level with the end of the motor shaft. In this position the print element, with its hooks, can be moved down on to the fixing plate. If, thereafter, the fixing plate 19 with a print element is allowed to spring back, the print element ascends the motor shaft and is latched thereon, and simultaneously a guide on the print element engages with the guiding recess 22 of the dog member 21 and retains the print element in its correct angular position.

The control of the print element motor is such that the motor shaft, when the motor is inactive, assumes a so-called home or viewable position. This means that the motor shaft is automatically transferred to a position in which the guiding recess 22 of the dog member is directed vertically upwards. In this position it is also possible to observe the print under the print element because a section of the upper part of the print element is removed.

Figure 3:
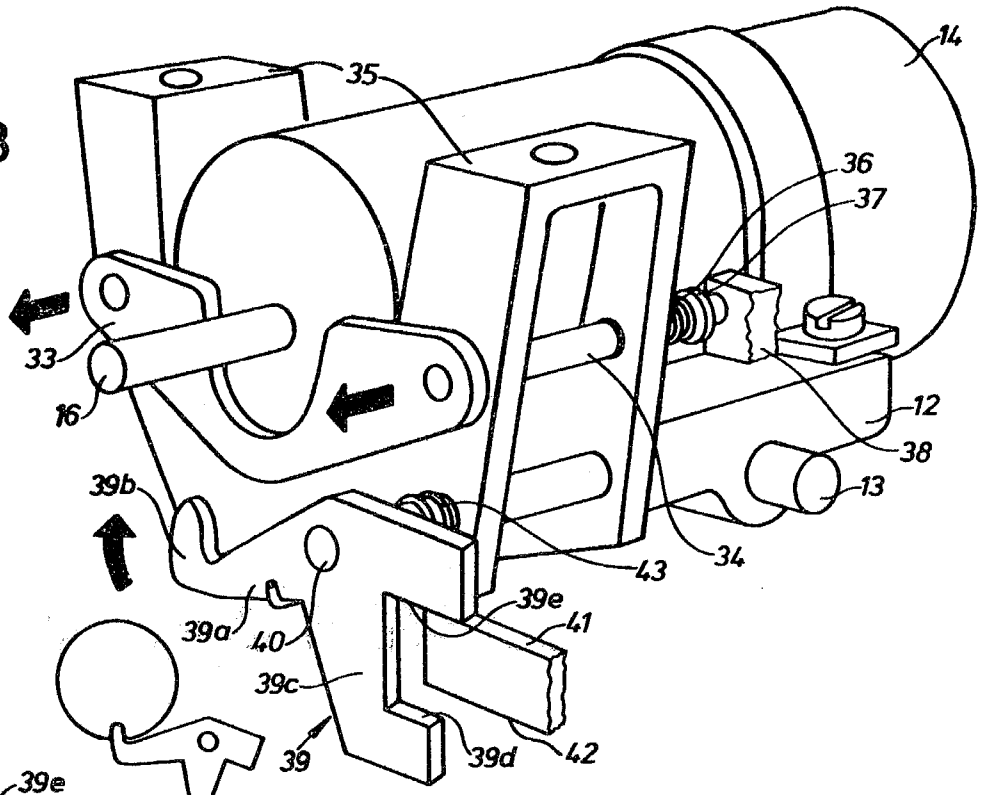
FIG. 3 is a perspective view showing a latch device, and a device for fixing the print element in position.

The device for acting on the pressure plate 25 is shown in FIG. 3 and comprises a disengagement plate 33 which, by means of a couple of rods 34, is movable back and forth parallel to the motor shaft 16. This movement of the rods 34 is guided by an upper part 35 of the support unit 12, which also carries the print element motor. The rods are surrounded by pressure springs 36 placed between the support unit 35 and a lock washer 37, with the disengagement plate normally being pressed against the end wall of the print element motor. Referring to the pivoting movement of the support unit, the ends of the rods 34 can be caused to engage with a stop 38 on the carriage. Upon said movement the stop 38 acts on the rods 34, so that the disengagement plate 33 is pressed against the pressure plate 25 which causes the fixing plate 19 to be moved outwards towards the shaft end. Consequently, the print element 17 can be detached. To ensure that the print element is latched in an angular position suitable for removal, the so-called home position, the arrangement has a catch 39 coacting with the recess 24 of the lock washer 23. The catch 39 is generally L-shaped and pivotable about a shaft 40 attached to the support unit 12. One leg 39*a* has a hook 39*b* which can engage with the recess 24 of the lock washer 23. The other leg 39*c* has an outer hook-shaped end with a stop surface 39*d*. The catch has another stop surface 39*e* designed to coact with a fixed, first operative surface 41 on the carriage whereas the stop surface 39*d* on some occasions coacts with a second operative surface 42. The catch 39 is movable under the action of a coil spring 43, so that the hook 39*b* is acted upon in the direction towards the lock washer 23.

The arrangement operates in the following manner.

In its normal printing position, i.e., the position shown in FIG. 1, the support unit 12 is locked in its lower front position, in which the print element is positioned on the shaft 16 since the coupling 18 is inactive. In this position the print element follows the turning movement of the shaft by the action of the dog member 21. Also in this position the stop surface 39*e* of the catch 39 abuts the first operative surface 41, which means that the hook 39*b* is free of the lock washer 23. When a print element is to be replaced and is in its home position, the fixing plate is in a position suitable for receiving the new print element. In this position (see FIG. 4, position 1) the support unit can be pivoted upwards to the position shown in FIG. 2 by means (not shown). During the pivoting movement the stop surface 39*e* disengages the first operative surface 41 and the hook 39*b* engages with the recess 24 of the lock washer 23 (see FIG. 4, position 3), thus retaining the dog member 21 and the fixing plate 19 in this position during exchange of the print element. During the pivoting movement, the stop 38 acts on the rods 34 so that the disengagement plate 33 moves the pressure plate 25, and hence the fixing plate 19, in the direction towards the outer end of the shaft 16. During this movement the guide of the print element disengages the guiding recess 22 and the print element is moved outside of the end of the shaft 16, so that the print element can be removed from the fixing plate and a new print element mounted thereon. Then, the support unit can again be pivoted forwards to its printing position, the print element being automatically fixed relative to the motor shaft and the hook 39*b* disengaging the recess 24 by the stop surface 39*e* being acted upon by the first operative surface 41.

In case the print element, for some reason, should not have assumed the correct position for removal, but is in the position represented by position 2 of FIG. 4, and the support unit is acted upon for pivoting upwards which will cause the stop surface 39*d* to engage with the second operative surface 42, then consequently the upwards movement of the support unit will be interrupted. Not until the recess 24, by turning of the print element, has been positioned directly opposite the hook 39*b* will it be possible to accomplish the pivoting movement and thereby to detach the print element.

It is to be understood that the present invention is not considered to be limited to the embodiment shown and described, but the embodiment herein may be modified within the scope of the following claims.

What is claimed is:

1. In an electric office machine provided with an electric motor in a printing unit having a print element, the improvement comprising an assembly for detachable connection of said print element to the shaft of said electric motor, a platen, a carriage mounting said printing unit for movement along said platen, said print element being disc-shaped having radially extending arms carrying characters thereon, means mounting said carriage for movement together with said printing unit along said platen, said printing unit being mounted to be movable on said carriage between a printing position and a loading position, a dog member, a spring loaded retaining means, said print element being biased against said dog member, the latter being secured to said motor shaft by said spring loaded retaining means, said retaining means being operated to release said print element for replacement by a fixed surface on said carriage engaging said retaining means when said printing unit is moved to a loading position, and wherein said retaining means comprises a fixing plate supporting said print element for movement along said motor shaft between a first position outside the end of said motor shaft in which the print element is released for replacement by a movement which is in a direction transverse relative to said motor shaft, and a second position in which the print element is secured for movement with said motor shaft, and a spring-loaded operating member, said fixing plate being operated to release said print element by said spring-loaded operating member engaging said fixed surface on said carriage.

2. An assembly as claimed in claim 6 further comprising a locking device which during the major part of the turning movement of said print element blocks movement of said printing unit to the loading position, but which releases the printing unit for such movement when the fixing plate has assumed a predetermined position.

3. An assembly as claimed in claim 2, wherein the locking device comprises a lock washer having a recess that is connected to said motor shaft and which coacts with a catch, said catch being capable of engaging said recess when the printing unit is operated for movement to said loading position.

4. An assembly as claimed in claim 3, further comprising a first operative surface fixed to said printing unit and wherein said catch is provided with a first stop which coacts with said first operative surface, and in the printing position of the printing unit maintains the catch out of engagement with said lock washer.

5. An assembly as claimed in claim 3, further comprising a second stop on said catch and a second operative surface, and wherein said second stop coacts with said second operative surface to prevent movement of the support unit from the printing position to the loading position as long as the catch is out of engagement with the lock washer.

6. An assembly as claimed in claim 3 wherein said catch is spring-loaded in the direction towards said lock washer.

* * * * *